United States Patent [19]

Idota

[11] 4,128,464

[45] Dec. 5, 1978

[54] PROCESS FOR REGENERATING BLEACHING-FIXING SOLUTION

[75] Inventor: Yoshio Idota, Minami-ashigara, Japan

[73] Assignee: Fuji Photo Film Co., Ltd., Minami-ashigara, Japan

[21] Appl. No.: 772,032

[22] Filed: Feb. 25, 1977

[30] Foreign Application Priority Data

Feb. 25, 1976 [JP] Japan ..... 51-19785

[51] Int. Cl.[2] ..... C25C 1/20

[52] U.S. Cl. ..... 204/151; 95/60 BF; 96/50 A; 204/109; 204/180 P

[58] Field of Search ..... 204/48, 46 R, 109, 112, 204/104, 130, 149, 151, 180 P; 96/50 A, 60 BF, 61 M, 61 R, 22, 55

[56] References Cited

U.S. PATENT DOCUMENTS

| | | | |
|---|---|---|---|
| 3,103,474 | 9/1963 | Juda | 204/104 |
| 3,124,520 | 3/1964 | Juda | 204/104 X |
| 3,634,088 | 1/1972 | Cooley | 96/50 X |
| 3,700,450 | 10/1972 | Cooley | 96/60 BF |
| 3,751,251 | 8/1973 | Surash | 96/50 R X |
| 3,832,453 | 8/1974 | Slovonsky et al. | 96/60 BF X |
| 3,907,568 | 9/1975 | Shirasu et al. | 96/60 BF |
| 4,013,527 | 3/1977 | Idota et al. | 204/151 |
| 4,036,715 | 7/1977 | Baden et al. | 204/109 |

*Primary Examiner*—Arthur C. Prescott

*Attorney, Agent, or Firm*—Sughrue, Rothwell, Mion, Zinn and MacPeak

[57] ABSTRACT

A process for electrolytically regenerating a used bleaching-fixing solution resulting from the processing of a color developed color photographic material with a bleaching-fixing solution containing an iron (III) chelate compound and a silver halide solvent, which comprises bubbling an oxygen-containing gas into an anode compartment containing said used bleaching-fixing solution while electrolyzing said used bleaching-fixing solution in an electrolytic cell.

10 Claims, 2 Drawing Figures

FIG. 1
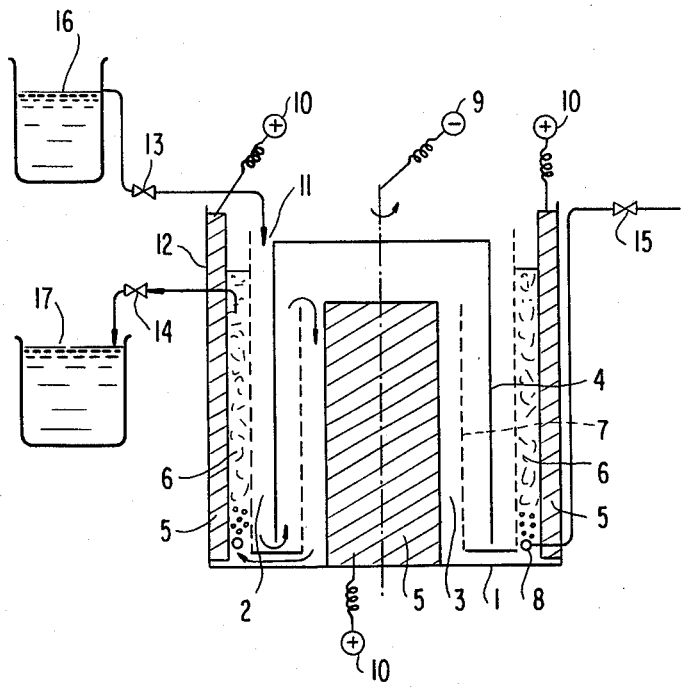
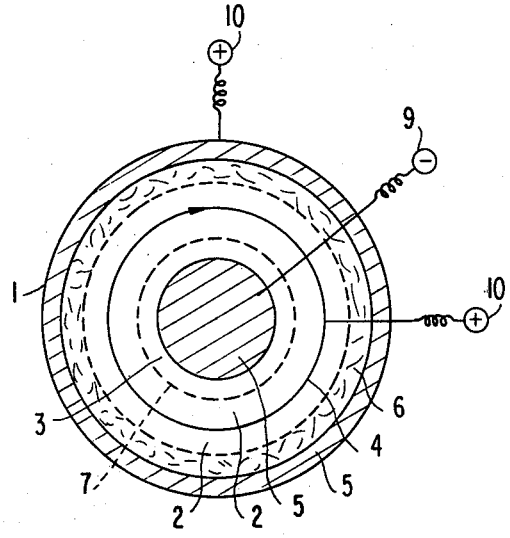
FIG. 2

PROCESS FOR REGENERATING BLEACHING-FIXING SOLUTION

BACKGROUND OF THE INVENTION

1. Field of the Invention

This invention relates to a process for regenerating a bleaching-fixing solution, and more specifically, to a process for regenerating a bleaching-fixing solution by electrolysis while maintaining the solution in contact with an oxygencontaining gas.

2. Description of the Prior Art

The processing of a silver halide color photographic material includes the two steps of color development and silver removal. When a color photographic material is subjected to color development, the exposed silver halide is reduced to silver, and simultaneously the oxidized color developing agent (oxidized aromatic primary amine) reacts with a coupler to form a dye image. The silver formed by the development is oxidized with a bleaching agent (oxidizing agent) in the silver removal step to convert the silver to silver halide which is then dissolved with a silver halide solvent and thus removed.

As described, the silver removal step includes the two steps of bleaching and fixing. In photographic processing methods now in actual use, the bleaching step and the fixing step are either separately carried out, or performed simultaneously as disclosed in U.S. Pat. No. 3,582,322.

An iron (III) chelate compound present in the bleaching-fixing solution oxidizes the developed silver during processing, and is itself reduced to a divalent iron salt. On the other hand, the silver ion formed by oxidation is dissolved by the fixing agent. Hence, as the processing is continued, the iron (II) salt and a silver complex salt gradually accumulate in the bleaching-fixing solution. Thus, the activity of the bleaching-fixing solution is decreased, and fatigue is exhibited. In order to prevent this, the bleaching-fixing solution is replenished with a suitable amount of a fresh supply of the bleaching-fixing solution at the time of development, and the used solution is discharged by an overflow from the tank. To discard the used solution directly is undesirable not only from the viewpoint of environmental pollution but also from an economical viewpoint. It would be very advantageous if the activity of the solution could be revived and the solution reused.

A method for recovering silver from a fixing bath can generally be utilized for recovering silver from a bleaching-fixing bath. Known methods for silver recovery in the photographic industry include:

(1) a method which comprises adding an agent for forming an insoluble silver salt to be used bleaching-fixing solution (silver precipitation method);

(2) a method which comprises contacting the used bleaching-fixing solution with a metal having a higher ionizing tendency than silver (metal substitution method)

(3) a method which comprises depositing silver on a cathode in an electrolytic cell (electrolyzing method); and (4) a method which comprises utilizing an ion exchange resin (ion exchange method).

The details of these methods are described in M. L. Schreibe "Present Status of Silver Recovery in Mothion-Picture Laboratories", *J. SMPTE,* Vol. 74, pages 505–514, (1965).

Various methods have been suggested heretofore on the oxidation of the iron (II) ion formed in the bleaching-fixing solution used. For example, the following methods are known:

(1) a method which comprises adding an oxidizing agent (described, for example, in U.S. Pat. Nos. 3,615,507 and 3,767,401, and German Patent Application (OLS) No. 2,149,314), (2) a method which comprises contacting the bleaching-fixing solution with oxygen (air) (described, for example, in U.S. Pat. Nos. 3,634,088 and 3,700,450, and German Patent Application (OLS) No. 2,113,651), and (3) a method involving electrolytic oxidation (described, for example, in Japanese Patent Application (OPI) No. 18191/73).

In oxidizing methods (1) and (2), the sulfite and thiosulfate ions in the solution are oxidized, and unwanted substances and the oxidizing agent added for regeneration in the solution are oxidized, and therefore, unwanted substances are accumulated in the revived solution. Accordingly, these methods require the discarding of the accumulated material and the replenishing of the components of which the amounts are deficient. Furthermore, method (2) cannot be conducted rapidly, and in order to obtain a regenerated bleaching-fixing soluiton having a satisfactory oxidizing capability, long periods of contact time are required. In contrast, in the electrolytic oxidation method (3), the oxidation proceeds without chemical reactions being involved, and therefore, only iron (II) ion advantageously is changed to iron (III) ion. For this reason, the electrolytic oxidation method is preferred.

However, when the electrolytic oxidation method is applied to the recovery of silver simultaneously with the oxidation of iron (II) ion, a reduction in iron (III) ion also occurs simultaneously with the reduction of the silver complex ion in the step of reduction (that is, at the cathode). Thus, a high oxidation capability is required at the anode (if sufficient oxidation is not performed, the regenerated bleaching-fixing solution does not have a sufficient bleaching action). In addition, where an anode is provided with a high oxidation capability, the sulfite and thiosulfate ions are oxidized at the same time. For this reason, it is not commercially acceptable to perform the oxidation of iron (II) ion in the bleaching-fixing bath and simultaneously to recover silver therefrom using the electrolytic method.

In particular, when thiosulfate and sulfite ions are decomposed, addtion of these ions in amounts corresponding to those decomposed must be added to the regenerated bleaching-fixing solution. From an economic viewpoint, this negates the advantage of the regenerating operation, and poses a serious problem. Accumulation of sulfate ions and other substances formed as a result of decomposition causes a retardation of the clearing time, and the sulfur ion formed by the reduction results in the formation of silver sulfide.

SUMMARY OF THE INVENTION

An object of this invention therefore is to provide a process for electrolytically oxidizing a bleaching-fixing solution in which the recovery of silver and the oxidation of iron (II) ion are performed simultaneously with a high efficiency.

Another object of the invention is to provide a process for electrolytically oxidizing a bleaching-fixing solution which can be used to provide a regenerated bleaching-fixing solution having a high bleaching capability.

Various investigations have now been performed in order to achieve the above objects, and it has now been found that the above objects can be achieved in the electrolytic oxidation of a used bleaching-fixing solution resulting from treating a color photographic material with a bleaching-fixing solution containing an iron (III) chelate compound and a silver halide solvent by bubbling an oxygen-containing gas into an anode compartment containing the used solution.

Accordingly, this invention provides a process for electrolytically regenerating a used bleaching-fixing solution resulting from the processing of a color developed color photographic material with a bleaching-fixing solution containing an iron (III) chelate compound and a silver halide solvent which comprises bubbling an oxygen-containing gas into the anode compartment containing the used bleaching-fixing solution while electrolyzing the used bleaching-fixing solution in an electrolytic cell. Preferably, the cathode compartment and the anode compartment in the electrolytic cell are separated by at least one diaphragm.

BRIEF DESCRIPTION OF THE ACCOMPANYING DRAWINGS

FIG. 1 is an elevation of an electrolytic cell used in this invention; and

FIG. 2 is a (top) plan of the electrolytic cell.

DETAILED DESCRIPTION OF THE INVENTION

This method involving contact of a bleaching-fixing solution with an oxygen-containing gas such as air is known as the method for oxidation of the bleaching-fixing solution, as described hereinabove, and has the defect that long periods of time are required until oxidation is completed. The process of this invention, however, involves the combined used of contact of the bleach-fixing solution with an oxygen-containing gas and electrolysis of the bleach-fixing solution. According to the process of this invention, oxidation is effected so rapidly by this combined use of oxygen-contact and electrolysis that the results obtained would not have been expected from the mere use of these operations together. In other words, the effect obtained is not a simple sum of the effects attained by the electrolytic oxidation and the oxidation with oxygen gas, but an interaction between the two occur to produce a synergistic effect. The efficiency of electrolytic oxidation is increased by the agitation achieved by the passing of the oxygen gas. Furthermore, when carbon fibers are used as an anode material, the efficiency of electrolysis and the efficiency of contact with the oxygen gas are both increased.

On the other hand, Japanese Patent Application (OPI) No. 18191/73 pertains to an electrolytic method in which the electrolytic system is shielded from air when the method is conducted. Such a method differs from the present invention. Electrolytic methods which do not involve the bubbling of an oxygen-containing gas are described in Japanese Patent Applications Nos. 89604/74, 90545/74, and 91033/74. The process of the present invention exhibits its characteristic effect especially markedly when such is used to regenerate a bleaching-fixing solution for long periods of time in a continuous manner. That is, an electrolytic regeneration, which does not involve the bubbling of an oxygen-containing gas into the solution during regeneration, depends upon the concentrations of iron (II) ions, silver complex ion, etc. Sometimes, a used solution having a very high concentration of iron (II) ions is obtained as an overflowing liquid. When such a solution is electrolytically regenerated by the methods disclosed in the above-cited patent applications, a bleaching-fixing solution having insufficient oxidizing capability results, and inconveniences sometimes occur. However, the process of the present invention can always be used to provide a bleaching-fixing bath having a sufficient oxidizing capability.

The invention is described below in detail by reference to the accompanying drawings:

Referring now to FIG. 1, an electrolytic cell 1 is made up of a cathode compartment 2, an anode compartment 3, a cathode 4, anodes 5 and 6, a diaphragm 7 separating the cathode compartment 2 from the anode compartment 3, and a tube 8 for supplying an oxygen-containing gas. The cathode 4 and the anodes 5 and 6 are connected to a direct current source by two lead wires 9 and 10. The anode 6 is made of carbon fibers (felt-like fibers), e.g., as described in Japanese Patent Application No. 89604/74. An inlet 11 and an outlet 12 of the electrolytic cell are capable of being opened and closed by valves 13 and 14. The arrows in the drawings show the direction of cathode rotation or the direction of the flow of the solution.

The used bleaching-fixing solution is introduced from a tank 16 into the cathode compartment 2 via the inlet 11, and the silver complex in the used bleaching-fixing solution deposits as silver onto the cathode (9) and is removed from the solution. Then, the solution is introduced into the anode compartment 3 past the diaphragm 7. The solution contacts an oxygen-containing gas in the anode compartment 3 and is oxidized and regenerated. The regenerated solution is conveyed through the outlet 12, and collected in a tank 17, thus completing the entire regeneration process.

The electrolytic cell is suitably made of an insulating material which is durable for use for long periods of time or for reuse, especially a synthetic resin. Preferably, such a material is made of polyvinyl chloride, polyvinyl methacrylate, polyethylene, polypropylene, or a phenol-formaldehyde resin. The cathode is made of an electrical conductor or semi-conductor that can withstand use for long periods of time or re-use. Stainless steel is an especially preferred material. The anode is an electrical conductor or semi-conductor which can withstand use for long periods of time or re-use, and preferably is carbon (including graphite) and/or carbon fibers.

The oxygen-containing gas used may be oxygen gas itself or any gas containing oxygen such as air and from an economical viewpoint, air is preferred. The amount of oxygen is at least about 0.25 mole, preferably 0.5 to 2.5 mole, per mole of the iron (II) ion in the solution (e.g., wherein, the mole of iron (II) ion corresponds to the complete conversion of a mole of aminopolycarboxylic acid iron (III) complex salt in the fresh blix solution to iron (II) ion), and depends upon the rate of feeding the oxygen-containing gas, the method of contacting the oxygen-containing gas with the bleaching-fixing solution, the conditions of electrolyzing the solution, and the composition of the bleaching-fixing solution. Accordingly, the amount of oxygen present in the oxygen-containing gas is determined primarily by the apparatus structure, and the composition of the bleaching-fixing solution.

Suitable electrolyzing conditions which can be used are described in Japanese Patent Applications Nos. 89604/74, 90545/74, and 91033/74. More specifically, the cathode potential is about −0.40 V to about −0.55 V, and the anode potential is about 0 to about 0.20 V (with reference to the potential of a saturated calomel electrode). In other words, the optimum inter-electrode potential is about 0.40 to about 0.80 V (including the potential due to the solution resistance). A suitable cathode current density is not less than about 0.01 $A/cm^2$, preferably not less than 0.05 $A/dm^2$, most preferably not less than 0.1 $A/dm^2$. The upper limit of the current density can vary widely depending upon the composition of the used blix solution but preferably is about 10 $A/dm^2$.

The shape of the cathode and of the anode may a circular, cylindrical, plate-like, granular, and fibrous shape. Expecially preferably, the cathode is cylindrical, and one anode is cylindrical and the other anode is made of fibers. Agitation of the solution within the cell is important, and is performed preferably by feeding the solution and/or rotating the cathode.

A diaphragm which is made preferably of a material which permits the passage of electrons and liquid, but is impermeable to large molecules and ions must be used. A suitable average pore size of the diaphragm is about 0.01 to 1 $\mu$, preferably 0.1 to 0.4 $\mu$. Examples of such a material are semi-permeable membranes (e.g., surface-hydrolyzed cellulose acetate membranes, cellophane membranes, copper ferrocyanide membranes, cystic membranes, intestinal membranes, and agar membranes), an asbestos plate, an unglazed plate, a thin glass sheet, sintered glass, glass fibers, microporous synthetic polymer membranes (e.g., polyvinyl chloride, polystyrene, polysulfone, polyester, or polypropylene membranes), and ion-exchange membranes (e.g., membranes obtained from the microporous synthetic polymeric membranes described above and ion exchange resins). Of these, microporous synthetic polymer membranes are preferred. The use of the diaphragm support shown in Japanese Utility Model Application No. 23856/75 is preferred.

The electrolytic cell should be so designed that the oxygen-containing gas is passed only into the anode compartment, and not to the cathode compartment. When an oxygen-containing gas is introduced into the cathode compartment, the iron (II) ion reduced by electrolysis is again oxidized with the oxygen-containing gas to iron (III) ion, and this process is repeated without hardly achieving any recovery of silver. In one example of such a cell, a gas flowing tube is provided at a position more than 1 cm above the bottom of the diaphragm support at the anode compartment.

The process of this invention can be performed either batchwise or continuously. The term batch process is used herein to describe a process whereby the used bleaching-fixing solution is regenerated separately from the bleaching-fixing step. The term continuous process is used to describe a process which comprises introducing a solution overflowing from a bath during the bleaching-fixing treatment into the silver recovering step described above, introducing the solution further into the electrolytic cell where it is regenerated, adding supplemental reagents to the regenerated solution, and recycling the regenerated solution to the bleaching-fixing bath. If desired, a device for removing unwanted chemical materials as by-products, for example, a device including an activated carbon or an ion exchange resin, may be provided in the electrolytic cell. A suitable flow amount of the used blix solution introduced into the electrolytic cell can vary widely depending upon the structure of the apparatus, the amount of iron (II) ion in the used blix solution, etc. However, a preferred flow rate is expressed by the following [volume of electrolytic cell] × (0.1 to 10)/hr.

As stated hereinabove, it is known to use a complex salt of an aminopolycarboxylic acid with iron (III) ion as a bleaching component of a bleaching-fixing agent. The aminopolycarboxylic acid iron (III) complex salt is a complex formed between ferric ion and an aminopolycarboxylic acid or a salt thereof (chelating agent). Alkali metal salts of aminopolycarboxylic acids can effectively used as the aminopolycarboxylic acid salt, and ammonium salts and water-soluble amine salts can also be used as well. Examples of alkali metal salts are the sodium, potassium, and lithium salt, and examples of water-soluble amine salts include alkylamine salts such as methylamine, diethylamine, triethylamine and butylamine salts, alicyclic amine salts such as cyclohexylamine salts, arylamine salts such as aniline and m-toluidine salts, and heterocyclic amine salts such as pyridine, morpholine and piperidine salts. Examples of aminopolycarboxylic acids include, for example, aminopolycarboxylic acids having four or more carboxyl groups such as ethylenediaminetetraacetic acid, diethylenetriaminepentaacetic acid, ethylene glycol bis(aminoethyl ether) tetraacetic acid and diaminopropanol tetraacetic acid, and aminotricarboxylic acids such as N-(2-hydroxyethyl) ethylenediamine triacetic acid. The ferric salt of an aminopolycarboxylic acid utilized in this invention is a salt in which the all of the cations contain ferric ion and at least one carboxyl group is bonded to an alkali metal ion. One example of such a salt is ferric sodium ethylenediaminetetraacetate. The present invention can also be applied to those salts which contain a monovalent cation other than the alkali metal ions. In addition to the ferric salts mentioned above, non-chelated salts of aminopolycarboxylic acids such as the tetrasodium salt of ethylenediaminetetraacetic acid can also be used.

The ferric ion complex salt can be used in the form of the complex salt as prepared, or the ferric ion complex salt can be formed in solution using a ferric salt such as ferric sulfate, ferric chloride, ferric nitrate, ferric ammonium sulfate, or ferric phosphate and an aminopolycarboxylic acid as a chelating agent. When such is used in the form of a complex salt, one or more complex salts may be used. On the other hand, when the complex salt is formed in solution using a ferric salt and a chelating agent, one or more ferric salts and one or more chelating agents may be used. In either case, the chelating agent may be used in an amount larger than that required to form the ferric ion complex salt. When a ferric ion complex salt is formed in solution using a ferric salt and an aminopolycarboxylic acid as a chelating agent, the chelating agent is used in an amount of about 1 to 2 mol/mol of ferric ion complex salt. A suitable amount of the iron (III) complex salt in the fresh blix solution is about 0.01 to 1 mol/l, preferably 0.02 to 0.5 mol/l.

Examples of suitable silver halide solvents copresent with such oxidizing agents are thiosulfates, thiocyanates, thioureas, thioglycols, and water-soluble organic diols containing sulfur and oxygen in the molecule such as 3,6-dithia-1,8-octyldiol. Other common additives for bleaching fixing solutions such as pH buffering salts, swell-inhibiting salts, or stabilizers such as sulfite salts may be added to the bleaching-fixing solution. (When a thiosulfate salt is used as the silver halide solvent, it is preferred to use a sulfite salt.) Generally the amount of silver halide solvent is about 0.1 to 3 mol/l, preferably 0.2 to 2 mol/l of the blix solution. Typical examples of bleaching-fixing solution are known not only from the disclosure of German Pat. No. 866,605, British Pat. No. 1,014,391, German Pat. No. 966,410, and U.S. Pat. No. 3,582,322, but also from the color developing methods designated by the main photographic companies in Europe as described in *The British Journal of Photography* pages 122, 123 and 126 (1960).

The color developing solution to be used in connection with the present invention is an alkali aqueous solution of an aromatic primary amine color developing agent of a known type, preferably containing benzyl alcohol. Typical examples of suitable color developing agents are phenylenediamine derivatives such as N,N-diethyl-p-phenylenediamine sulfate, 4-amino-N-ethyl-N-β-hydroxyethylaniline sulfate, 3-methyl-4-amino-N-ethyl-N-methane-sulfonamidoethylaniline sesquisulfate monohydrate, 3-methyl-4-amino-N-ethyl-N-β-hydroxyethylaniline sulfate, and 3-methyl-4-amino-N,N-diethylaniline hydrochloride. Known additives for developers, such as the alkali metal sulfites, carbonates, busulfites, bromides, iodides, antifoggants, developement accelerators, and solvents such as diethylene glycol, can be incorporated in the color developer.

The color photographic material used in the process of this invention can be any multi-layered gelatin-silver halide photographic material.

The following Examples are given to further illustrate the present invention in greater detail. Unless otherwise indicated herein, all parts, percents, ratios, and the like are by weight.

EXAMPLE 1

A color photographic paper was prepared by coating a baryta paper with a blue-sensitive silver bromide emulsion containing an emulsified yellow coupler, a green-sensitive silver chlorobromide emulsion (containing 2.0 mole% of silver chloride) containing an emulsified magenta coupler, a red-sensitive silver chlorobromide emulsion (containing 70 mole% of silver chloride) containing an emulsified cyan coupler, and a gelatin layer containing an ultraviolet absorber. Each of the coupler emulsions used in preparing the color paper was prepared by dissolving each coupler in a mixture of dibutyl phthalate and tricresyl phosphate, and dispersing the solution in a gelatin solution using sorbitan monolaurate, Turkey red oil and sodium dodecylbenzenesulfonate as emulsifiers to form an oil-in-water type emulsion. The couplers used were 1-(2',4',6'-trichlorophenyl)-3-[3''-(2''',4'''-di-t-amylphenoxyacetamido)benzamido]-5-pyrazolone, N-n-dodecyl-1-hydroxy-4-chloro-2-naphthamide, and α-(2-methylbenzoyl)-aceto-(2'-chloro-5'-dodecoxycarbonyl)anilide. The ultraviolet absorber used was that described in Japanese Patent Publication No. 9586/70 (corresponding to U.S. Pat. No. 3,512,984). 2,4-Dichloro-6-hydroxy-1,3,5-triazine sodium salt was incorporated in the emulsions as a hardening agent.

The color photographic paper so prepared was exposed with a color printer (white light; 1000 CMS; 1 sec), and subjected to the following color developing treatments.

| Developing Steps | Temperature (° C) | Time (minutes) |
|---|---|---|
| Color Development | 30 | 6 |
| Bleaching-Fixing | 30 | 2 |
| Rinsing | 30 | 2 |
| Stabilizing Bath | 30 | 2 |
| Drying | 30 | 2 |

The compositions of the processing solutions used are shown below.

| | |
|---|---|
| Color Developer | |
| Benzyl Alcohol | 12 ml |
| Diethylene Glycol | 3.5 ml |
| Sodium Hydroxide | 2.0 g |
| Sodium Sulfite | 2.0 g |
| Potassium Bromide | 0.4 g |
| Sodium Chloride | 1.0 g |
| Borax | 4.0 g |
| Hydroxylamine Sulfate | 2.0 g |
| Ethylenediaminetetraacetic Acid | 2.0 g |
| 4-Amino-3-methyl-N-ethyl-N-(β-sulfonamidoethyl)-aniline Sesquisulfate (monohydrate) | 5.0 g |
| Water to make | 1 liter |
| Stabilizing Bath | |
| Boric Acid | 5 g |
| Sodium Citrate | 5 g |
| Sodium Metaborate (tetrahydrate) | 3 g |
| Potassium Alum | 15 g |
| Water to make | 1 liter |

The color photographic paper described above which had been printed, and developed with a color developer having the composition described above, was subsequently bleached and fixed as described above in a bleaching-fixing solution as described below.

| Bleaching-Fixing Solution | |
|---|---|
| Ferric Sulfate | 20 g |
| Disodium Ethylenediaminetetraacetate Dihydrate | 36 g |
| Sodium Carbonate (monohydrate) | 17 g |
| Sodium Sulfite | 5 g |
| Ammonium Thiosulfate (70% aq. soln.) | 100 ml |
| Boric Acid | 5 g |
| pH | adjusted to 6.8 |
| Water to make | 1 liter |

The bleaching-fixing solution was used until the content of the silver complex salt accumulated therein had reached about 3.0 g/liter (calculated as silver) (about 55 $m^2$ of the color photographic paper was used). At this time, the concentration of iron (II) in the solution was 26.4 millimoles/liter.

An electrolytic cell having an inside diameter of 20 cm and a height of 35 cm was used. The electrolytic cell was equipped with a cylindrical cathode of stainless steel having an outside diameter of 15 cm and a height of 28 cm (with an available surface area of about 20 $dm^2$) and anodes respectively of cylinderical carbon and felt-like carbon fibers. A polyvinyl chloride membrane was used as a diaphragm. The available volume of the electrolytic cell equipped with the cathode, anodes and diaphragm was about 5 liters. The electrolytic cell was filled with 5 liters of used bleaching-fixing solution and the inter-electrode potential was set at 0.70 V. The cathode potential was −0.5 V (with reference to the potential of a saturated calomel electrode) and the anode potential was +0.1 V (with reference to the potential of a saturated calomel electrode). Thus 0.1 V is due to the resistance in the electrolysis. At this time, the current was 8 A, and thus, the current density at the cathode was 0.4 A/dm$^2$. Electrolysis was carried out while passing the used bleaching-fixing solution at a rate of 5 liters per hour and air as an oxygen-containing gas at a rate of 0.5 liter per minute through the anode compartment. In 4 hours (20 liters of the solution were therefore treated), the silver concentration and the iron (II) concentration in the treated solution became 1.0 g/liter, and 0.5 milimole/liter, respectively. The amount of sodium sulfite decreased by 28% to 3.6 g/liter, but the amounts of ammonium thiosulfate and other reagents did not change. The pH of the solution increased to 6.98.

For comparison, the used bleaching-fixing solution obtained as described above was regenerated in accordance with the Example of U.S. Pat. No. 3,634,088, and the amount of sodium sulfite decreased by 63% (pH increased to 7.97 from the original 7.19) after te recovery of silver, and by about 86% (pH rose to 8.02) after passing air through the solution.

As is clear from the results obtained, the process of this invention permits the recovery of silver with a sufficient efficiency for practical purposes, and the amounts decreased of the other components, particularly sodium sulfite are far smaller than in the conventional processes. Furthermore, the change of pH in the present invention is similar to that of the pH of the fresh solution and therefore, the process of the invention is useful for regeneration.

COMPARATIVE EXAMPLE 1

The used bleaching-fixing solution obtained as described in Example 1 was electrolyzed using the same device as used in Example 1 but without bubbling air through the solution in the anode compartment during the electrolysis. In 4 hours, the concentrations of silver and iron (II) were 1.0 g/liter, and 1.8 millimoles/liter, respectively. The amount of sodium sulfite decreased by 16% to 4.2 g/liter, but the amounts of ammonium thiosulfate and other reagents did not change. At this time, the pH of the solution increased to 6.90.

A comparison of the results of this example with those in Example 1 shows that in Example 1, the concentration of iron (II) is small, and the decrease of sodium sulfite is great, but in a continuous process for long periods of time, smaller amounts of iron (II) formed are more preferred, and a revived bleaching-fixing solution having satisfactory oxidizing capability can be obtained.

EXAMPLE 2

The silver removal time and maximum densities of the dye images obtained by using the solution regenerated in Example 1 (designated Solution A), the solution continuously regenerated through 20 cycles by the method set forth in Example 1 (designated Solution B), the solution regenerated in Comparative Example 1 (designated Solution C), and the solution continuously regenerated through 20 cycles by the method set forth in Comparative Example 1 (designated Solution D) were determined, and compared with those of an unused bleaching-fixing solution. The results obtained are tabulated below.

| | Solution | | | | | |
|---|---|---|---|---|---|---|
| | Unused | A | B | C | D | After Use |
| Silver Removal time (seconds) | 16 | 16 | 16 | 16 | 20 | 21 |
| Maximum Density of Dye Image | | | | | | |
| Red-Sensitive Layer | 1.8 | 1.8 | 1.8 | 1.8 | 1.8 | 1.8 |
| Green-Sensitive Layer | 1.9 | 1.9 | 1.9 | 1.9 | 1.8 | 1.7 |
| Blue-Sensitive Layer | 1.9 | 1.9 | 1.9 | 1.9 | 1.8 | 1.8 |

The samples and test conditions used in the above tests were as follows:

Silver Removal Time

A commercially available motion-picture black-and-white positive film was developed in a bright room with D-72 (diluted 1:2 with water) at 20° C. for 2 minutes, and then fixed with Super Fujifix produced by the Fuji Photo Film Co., Ltd. The sample obtained was then dipped in a bleaching-fixing bath as described in the table above, and the time required for the sample to become transparent was determined and made the silver removal time.

Samples for the Determination of Maximum Density of the Dye Image

A color paper prepared as described in Example 1 and subjected to the processings as described in Example 1 was used and the maximum density of the dye image formed therein was measured.

While the invention has been described in detail and with reference to specific embodiments thereof, it will be apparent to one skilled in the art that various changes and modifications can be made therein without departing from the spirit and scope thereof.

What is claimed is:

1. A process for electrolytically regenerating a used bleaching-fixing solution resulting from the processing of a color developed color photographic material with a bleaching-fixing solution containing an iron (III) chelate compound and a silver halide solvent in an electrolytic cell comprising anode and cathode compartments separated by a diaphragm wherein the anode is carbon and/or carbon fibers, the cathode potential is −0.40V to −0.55V, the anode potential is 0 to about 0.20V, said potentials being with reference to a standard calomel electrode, and the inter potential is 0.4 to 0.8V; which comprises bubbling an oxygen-containing gas into the anode compartment containing said used bleaching-fixing solution while electrolyzing said used bleaching-fixing solution and; recycling the regenerated solution to a bleach-fixing bath in an electrolytic cell.

2. The process of claim 1, wherein the amount of the oxygen-containing gas is at least about 0.25 mole per mole of the iron (II) ion in the used bleaching-fixing solution.

3. The process of claim 1, wherein said oxygen-containing gas is air.

4. The process of claim 1, wherein the cathode in the electrolytic cell is a rotary cathode.

5. The process of claim 1, wherein said diaphragm is a microporous synthetic polymer membrane.

6. The process of claim 1, wherein the average pore size in said diaphragm is about 0.01 to about 1 μ.

7. The process of claim 1, wherein the current density at the cathode in said electrolytic cell is at least about 0.01 $A/dm^2$.

8. The process of claim 1, wherein said electrolytic cell includes a device containing an activated carbon or an ion exchange resin.

9. The process of claim 1, wherein the cathode material for the electrolytic cell is stainless steel.

10. The process of claim 1, wherein said process consists essentially of bubbling said oxygen containing gas into said anode containing compartment while electrolyzing said bleach fixing solution such that the oxidation of iron (II) to iron (III) at the anode is faster than the reduction of iron (III) to iron (II) at the cathode.

* * * * *